US010262635B2

(12) United States Patent
Klusewitz

(10) Patent No.: US 10,262,635 B2
(45) Date of Patent: Apr. 16, 2019

(54) INSTRUMENT HAND REST

(71) Applicant: Steven Klusewitz, Morgantown, PA (US)

(72) Inventor: Steven Klusewitz, Morgantown, PA (US)

( * ) Notice: Subject to any disclaimer, the term of this patent is extended or adjusted under 35 U.S.C. 154(b) by 0 days.

(21) Appl. No.: 15/680,395

(22) Filed: Aug. 18, 2017

(65) Prior Publication Data

US 2018/0053493 A1 Feb. 22, 2018

Related U.S. Application Data

(60) Provisional application No. 62/377,121, filed on Aug. 19, 2016.

(51) Int. Cl.
*G10D 3/18* (2006.01)

(52) U.S. Cl.
CPC ..... *G10D 3/18* (2013.01)

(58) Field of Classification Search
CPC ..... G10D 3/18; G10H 3/181; G10H 3/183
See application file for complete search history.

(56) References Cited

U.S. PATENT DOCUMENTS 401,814 A * 4/1889 Bohmann ..... G10D 3/18 84/328
2,064,925 A * 12/1936 Vlado ..... G10D 3/18 84/280
2,089,171 A * 8/1937 Beauchamp ..... G10H 3/181 381/118
2,248,854 A * 7/1941 Frederick ..... G10D 3/18 84/280
2,976,755 A * 3/1961 Fender ..... G10H 3/183 84/267
3,353,433 A * 11/1967 Webster ..... G10D 3/04 84/294
D210,851 S * 4/1968 Wallac ..... 84/328
D287,602 S * 1/1987 Smith ..... D17/20
D381,356 S * 7/1997 Pelkey ..... 84/328
7,453,033 B2 * 11/2008 Redard ..... G10H 3/183 84/213
8,283,542 B2 10/2012 Woodland et al.
8,927,839 B2 * 1/2015 Hammack ..... G10D 3/18 84/328
9,240,168 B1 * 1/2016 Steinberger ..... G10D 1/08
9,299,327 B1 * 3/2016 Steinberger ..... G10D 3/18
9,576,562 B1 * 2/2017 Porter ..... G10D 1/08
9,928,812 B2 * 3/2018 Porter ..... G10D 3/18
2006/0054009 A1 * 3/2006 Redard ..... G10H 1/32 84/723
2014/0144307 A1 5/2014 Estrada
2018/0053493 A1 * 2/2018 Klusewitz ..... G10D 3/18

* cited by examiner

*Primary Examiner* — Robert W Horn
(74) *Attorney, Agent, or Firm* — Global Intellectual Property Agency, LLC; Daniel Boudwin

(57) ABSTRACT

A floating bridge hand rest. The floating bridge hand rest includes a central body having a pair of opposing ends. The pair of opposing ends curve away from the central body to create an arcuate shape. A securing member is affixed to at least one of the pair of opposing ends, wherein the securing member can removably secure the central body to an instrument. A plurality of risers are removably securable to the securing members, wherein the plurality of risers can elevate the central body to a desired height. In some embodiments, a track is disposed on the instrument, such that one of the pair of opposing ends is slidably engaged therein.

14 Claims, 5 Drawing Sheets

INSTRUMENT HAND REST

CROSS REFERENCE TO RELATED APPLICATIONS

This application claims the benefit of U.S. Provisional Application No. 62/377,121 filed on Aug. 19, 2016. The above identified patent application is herein incorporated by reference in its entirety to provide continuity of disclosure.

BACKGROUND OF THE INVENTION

The present invention relates to hand rest bars for musical instruments. Specifically, the present invention relates to a hand rest bar for a musical instrument that extends above a floating bridge.

Many instruments, such as guitars, have a floating or moving bridge where the strings of the instrument at the bridge are supported between two points. When a musician plays an instrument with a floating bridge, the musician must find an anchor point for their strumming hand while precisely picking the strings, such as above or below the strings. Frequently, musicians use the bridge itself to anchor their hand, however this can cause tuning and sound discrepancies, leading to an undesired sound. Additionally, inconsistent hand positioning can make learning the instrument much more difficult, leading to more frequent mistakes. Many musicians avoid this problem by only playing instruments with fixed bridges, which can be used as an anchor point without negatively impacting the sound, however this limits the variety of sounds the instrument can create. Additionally, alternate devices require a user to remove the device to strum the guitar. Therefore, a device that can act as a hand rest to be used with an instrument having a floating bridge is needed.

In light of the devices disclosed in the known art, it is submitted that the present invention substantially diverges in design elements from the known art and consequently it is clear that there is a need in the art for an improvement to existing hand rests for musical instruments. In this regard, the instant invention substantially fulfills these needs.

SUMMARY OF THE INVENTION

In view of the foregoing disadvantages inherent in the known types of musical instrument hand rests now present in the prior art, the present invention provides a musical instrument hand rest wherein the same can be utilized for providing convenience for the user when using a musical instrument having a floating bridge.

The present system comprises a central body having a pair of opposing ends. The pair of opposing ends curve perpendicularly away from the central body such that an arcuate shape is formed thereby. A securing member is affixed to at least one of the pair of opposing ends, wherein the securing member is configured to removably secure the central body to an instrument. A plurality of risers removably secure to the securing members, wherein the plurality of risers are configured to elevate the central body to a desired height. In some embodiments, the securing member comprises a track disposed perpendicular to the central body, wherein one of the pair of opposing ends is slidably engaged with the track. In another embodiment, a lower surface of the track comprises a high friction material. In other embodiments, the securing member comprises a plate disposed perpendicularly to each of the pair of opposing ends, wherein each plate comprises at least one aperture thereon, the aperture configured to receive a fastener therethrough. In yet another embodiment, the plurality of risers each comprise a U-shaped cutout configured to receive the fastener therein. In some embodiments, the central body comprises a planar upper surface parallel to a mounting surface of the instrument. In another embodiment, the planar upper surface comprises a wider cross-section than the pair of opposing ends.

An alternate embodiment of the present system comprises a central body having a pair of opposing ends, wherein the pair of opposing ends curve perpendicularly away from the central body creating an arcuate shape. A securing member is disposed on at least one of the pair of opposing ends, the securing member having an aperture therein configured to receive a fastener therethrough. A track is removably affixed to an instrument at a connector, wherein the securing member is slidably engaged with the track. In some embodiments, the track further comprises a plurality of openings, wherein the plurality of openings are configured to receive a fastener therethrough. In another embodiment, a platform configured to receive the fastener therein is slidably engaged with the track, wherein the platform is further configured to frictionally engage the securing member between the platform and the track when the fastener is tightened. In other embodiments, the track is rotatably affixed to the instrument about the connector. In yet another embodiment, the central body is configured to rotate about the aperture. In some embodiments, a lower side of the securing member comprises a high friction material. In another embodiment, the central body comprises a planar upper surface parallel to a mounting surface of the instrument. In other embodiments, the planar upper surface comprises a wider cross-section than the pair of opposing ends. In yet another embodiment, a lower surface of the track further comprises a high friction material.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
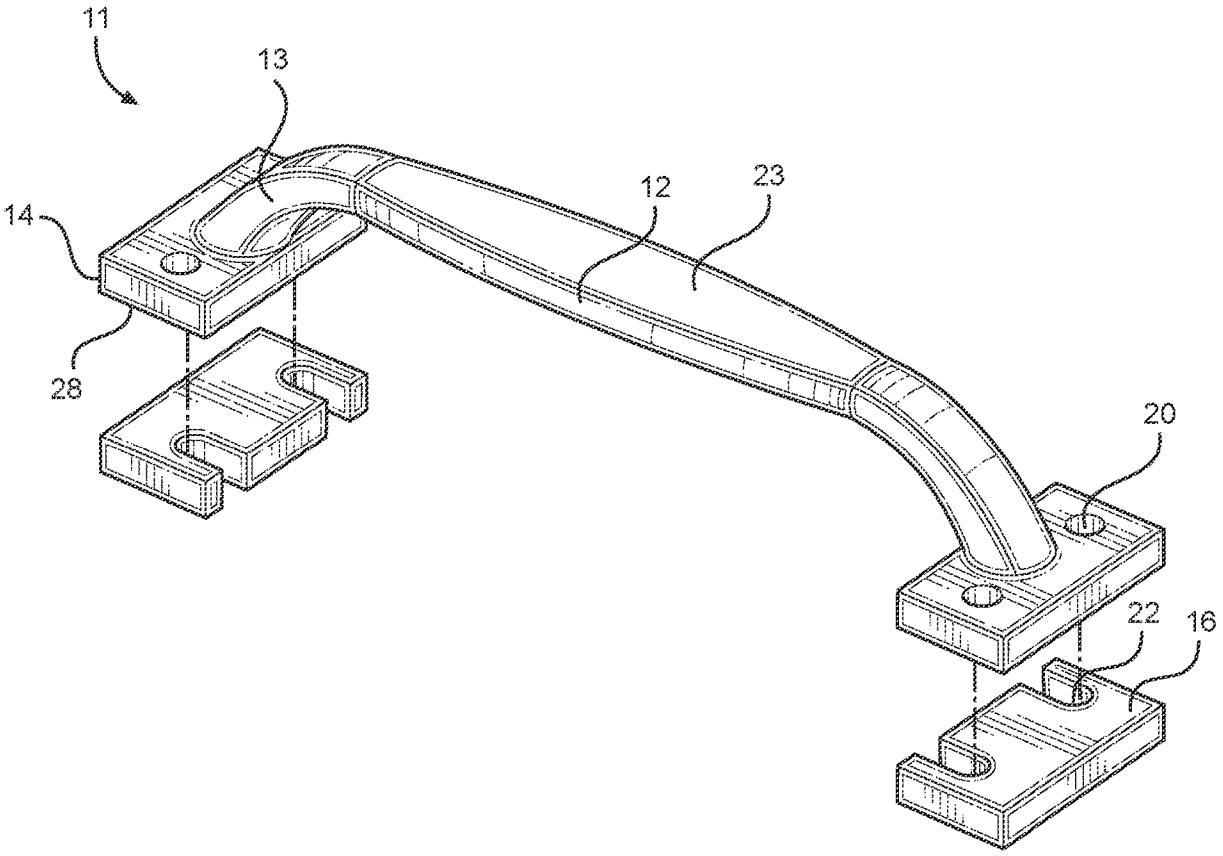
FIG. 1 shows a perspective view of an embodiment of the floating bridge hand rest with a plurality of risers.

Reference is made herein to the attached drawings. Like reference numerals are used throughout the drawings to depict like or similar elements of the floating bridge hand rest. The figures are intended for representative purposes only and should not be considered to be limiting in any respect.

Figure 2:
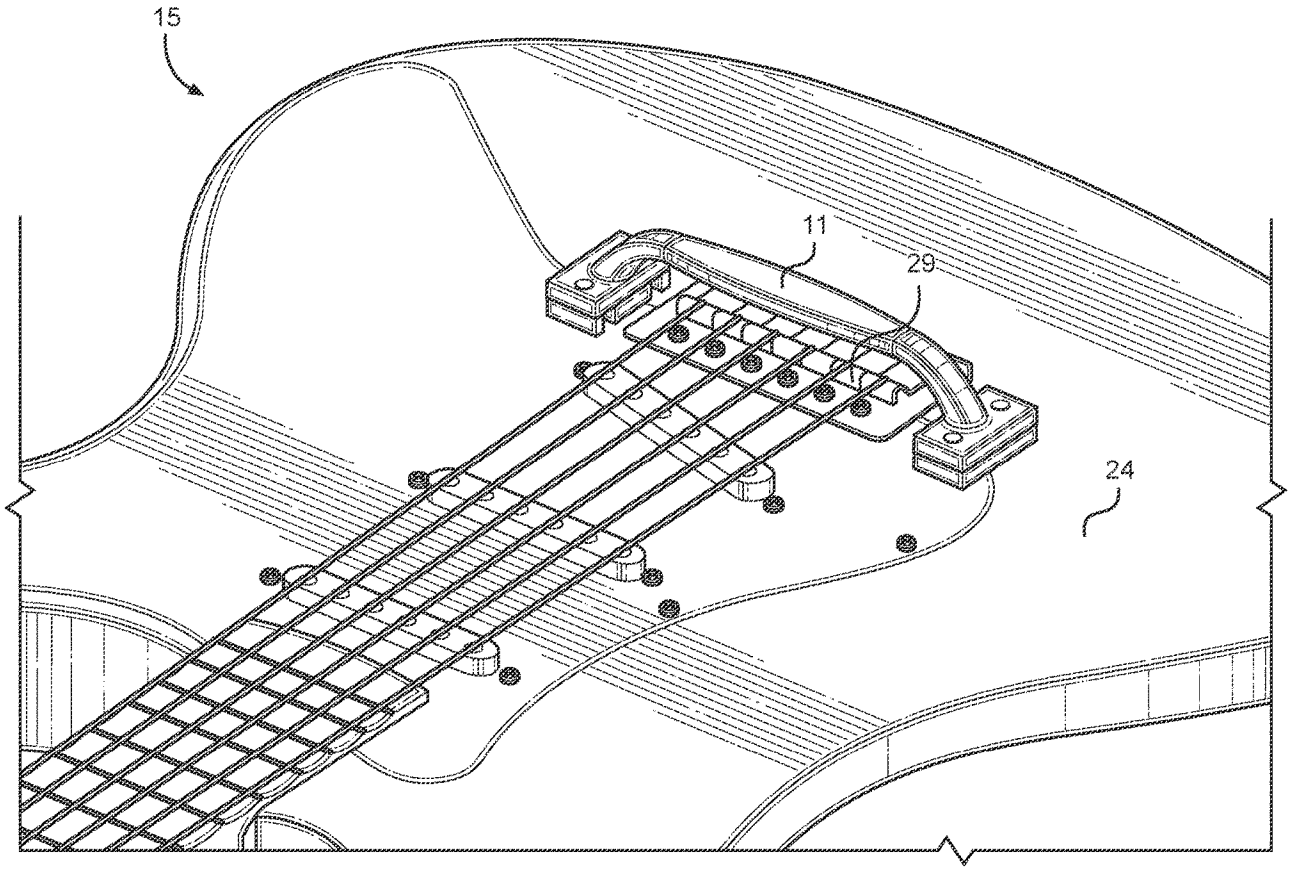
FIG. 2 shows a perspective view of an embodiment of the floating bridge hand rest affixed to an instrument.

Referring now to FIGS. 1 and 2, there is shown a perspective view of an embodiment of the floating bridge hand rest with a plurality of risers and a perspective view of an embodiment of the floating bridge hand rest affixed to an instrument, respectively. The floating bridge hand rest 11 comprises a central body 12 having a pair of opposing ends 13. In the illustrated embodiment, the central body 12 comprises a planar upper surface 23, wherein the planar upper surface 23 comprises a wider cross-section than the pair of opposing ends 13. In this way, the planar upper surface 23 provides a user a surface upon which to rest their hand while playing an instrument 15. The pair of opposing ends 13 curve away from the central body 12 forming an arcuate shape. A securing member 14 is disposed on each of the pair of opposing ends 13, wherein the securing member 14 is configured to removably secure to the instrument 15. In the illustrated embodiment, the securing member 14 comprises a plate disposed perpendicularly to the pair of opposing ends 13, the plate having at least one aperture 20 thereon, the aperture 20 configured to receive a fastener therethrough.

The floating bridge hand rest 11 further comprises a plurality of risers 16 configured to removably secure to the securing member 14. The plurality of risers 16 are configured to elevate the central body 12 to a desired height above the instrument 15. Additional risers 16 can be removably secured to the securing member 14 to increase the distance between the central body 12 and the instrument 15. In the illustrated embodiment, the plurality of risers 16 further comprise at least one U-shaped cutout 22, the U-shaped cutout 22 configured to receive the fastener therein. The U-shape allows a user to slide the riser 16 under the securing member 14 while a user is removably securing the securing member 14 to the instrument 15. In this way, a user can better judge how many risers 16 are necessary to achieve the desired height of the central body 12. In the illustrated embodiment, the risers 16 comprise the same dimensions as the securing member 14, such that the lower surface of the securing member 14 is adapted to rest flush against the upper surface of the riser 16. The aperture 20 is adapted to alight with the U-shaped cutout 22.

In the illustrated embodiment of FIG. 2, the floating bridge hand rest 11 is removably secured to an instrument 15 above a bridge 29 of the instrument 15. In one exemplary use, a user determines the height required for the floating bridge hand rest 11 to clear the bridge 29 without contacting the strings of the instrument 15. The user then inserts risers 16 beneath the securing members 14 until the floating bridge hand rest 11 is at the desired height. The floating bridge hand rest 11 is then removably secured to the instrument 15 at a mounting surface 24 via fasteners inserted through the apertures 20 and cutouts 22 of the securing member 14 and the risers 16. In the illustrated embodiment, the floating bridge hand rest 11 is removably secured to the instrument 15 such that the planar upper surface 23 rests parallel to the mounting surface 24. In this way, the user is provided with a secure and stationary place to rest their hand while playing the instrument 15, such that the strings are not contacted affecting the sound of the instrument 15.

Figure 3:
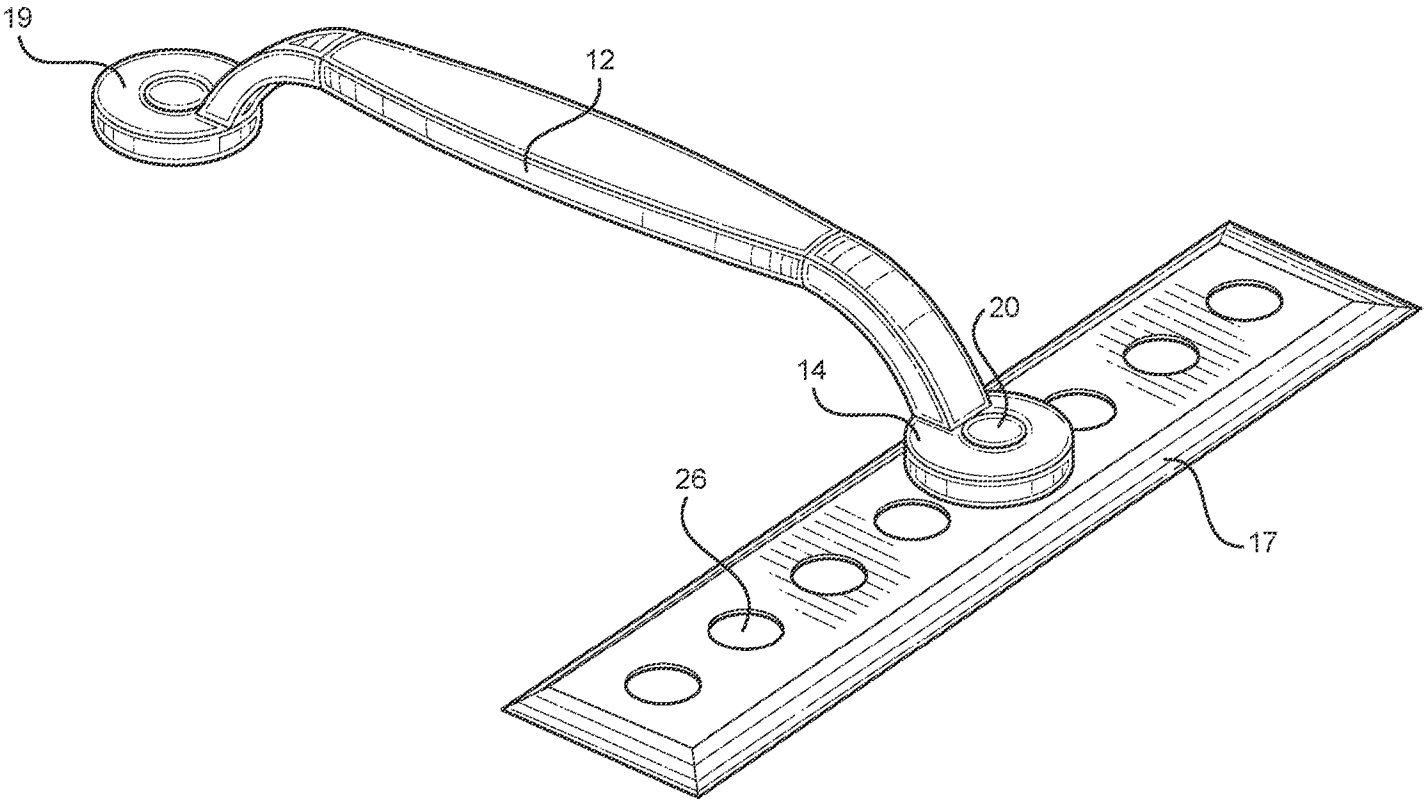
FIG. 3 shows a perspective view of an embodiment of the floating bridge hand rest with a track having a plurality of apertures.

Referring now to FIG. 3, there is shown a perspective view of an embodiment of the floating bridge hand rest with a track having a plurality of apertures. In the illustrated embodiment, the securing member 14 comprises a circular cylinder having an aperture 20 therein, the aperture 20 configured to receive a fastener therethrough. The securing member 14 is slidably engaged with a track 17. In the illustrated embodiment, the track 17 comprises a plurality of openings 26, each configured to receive a fastener therethrough. In this way, the securing member 14 can be removably secured to the track 17 via a fastener engaging with the aperture 20 and one of the plurality of openings 26. In some embodiments, the aperture 20 and the plurality of openings 26 are threaded to promote engagement of the fastener. In other embodiments, a lower side of the track 17 further comprises a material having a coefficient of friction greater than one. In this way, the track 17 is prevented from moving along the mounting surface of the instrument.

The securing member 14 is configured to move along the length of the track 17, such that the position of the floating bridge hand rest is adjustable along the length of the track 17. In the illustrated embodiment, the securing member 14 has a height greater than a disc 19 disposed on the opposing end, such that the disc 19 is supported over the instrument. The floating bridge hand rest is further configured to rotate about the aperture 20 within the track 17. In this way, the position of the floating bridge hand rest can be further adjusted. In one exemplary use, when the user has determined the desired location of the floating bridge hand rest, the user aligns the aperture 20 with one of the plurality of openings 26. A fastener is then inserted through both the aperture 20 and one of the plurality of openings 26 such that the fastener engages the aperture 20 and the opening 26. In this way, the floating bridge hand rest is removably secured to the track 17, such that the floating bridge hand rest can no longer slide or rotate within the track 17. At least one riser, as shown in FIG. 1, can then be removably secured to the lower side of the disc 19 such that the floating bridge hand rest is supported against the instrument at each end. In some embodiments, the riser comprises the same cross-section as the disc 19. In another embodiment, the riser comprises a lower surface having a coefficient of friction greater than one, to prevent the floating bridge hand rest from rotating.

Figure 4:
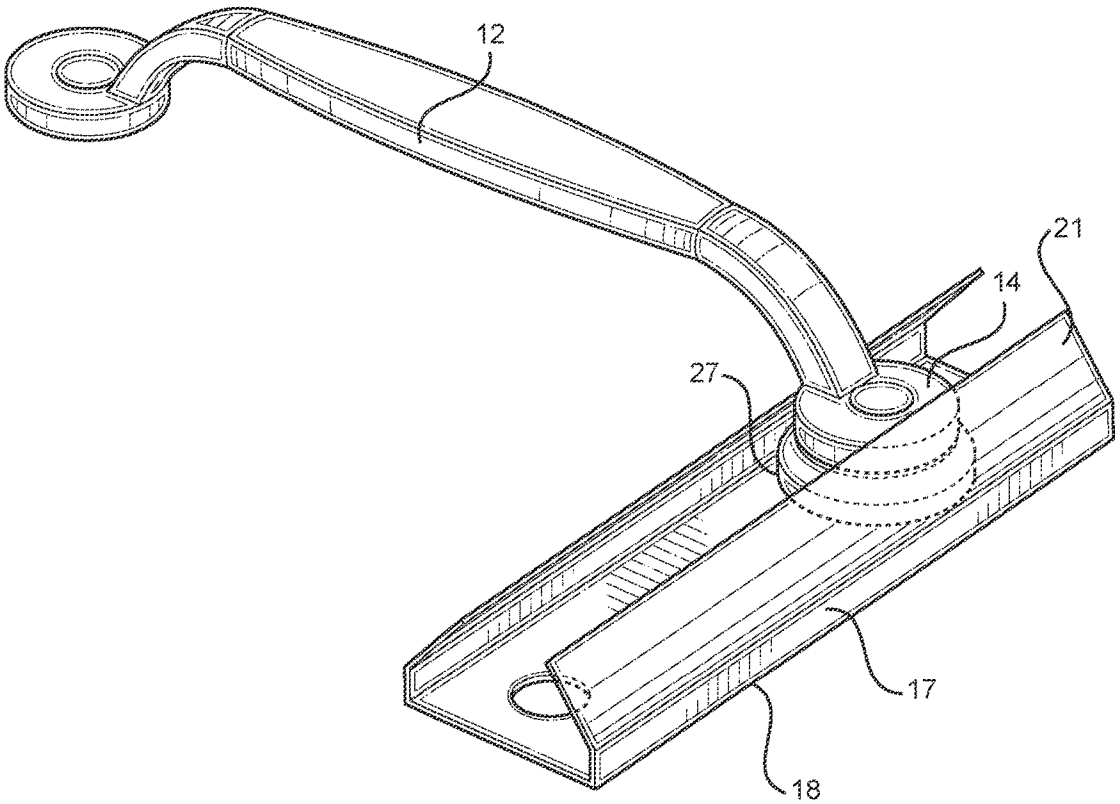
FIG. 4 shows a perspective view of an embodiment of the floating bridge hand rest with a track and platform.

Referring now to FIG. 4, there is shown a perspective view of an embodiment of the floating bridge hand rest with a track and platform. In the illustrated embodiment, the floating bridge hand rest further comprises a platform 27 affixed to a lower side of the securing member 14. The platform 27 is slidably engaged with the track 17 along with the securing member 14. In some embodiments, the lower side 18 of the track 17 comprises a material having a coefficient of friction greater than one, such that the track 17 remains stationary against the instrument. The platform 27 is further configured to receive a fastener therein, the fastener inserted through the aperture disposed within the securing member 14. The platform 27 is configured to engage the fastener, such that the platform 27 rises as the fastener is tightened. In this way, the securing member 14 is frictionally engaged between the platform 27 and a pair of upper arms 21 of the track 17, thereby preventing the floating arm hand rest from moving along the track 17.

Figure 5:
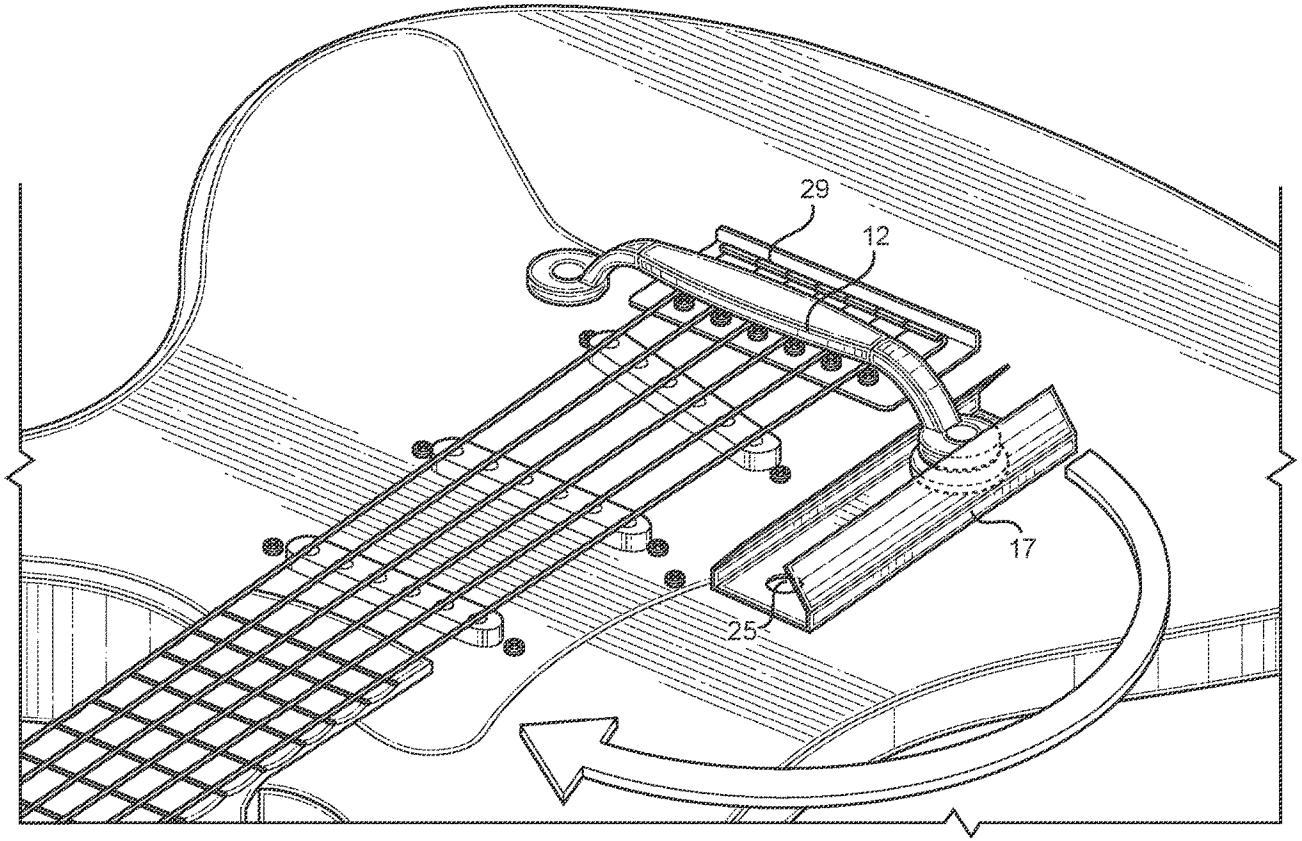
FIG. 5 shows a perspective view of an embodiment of the floating bridge hand rest with a track affixed to an instrument.

Referring now to FIG. 5, there is shown a perspective view of an embodiment of the floating bridge hand rest with a track affixed to an instrument. In the illustrated embodiment, the track 17 further comprises a hole 25 configured to receive a fastener therethrough, thereby removably securing the track 17 to the instrument. The track 17 is rotatable about the hole 25, such that the track 17 can be placed in a desired position. Additionally, the floating bridge hand rest is rotatable about the aperture within the track 17. This allows a user additional flexibility in positioning the central body 12 over the bridge 29, such that each user can select a the most comfortable position to the user. The user then tightens the fastener to frictionally engage the securing member between the platform and the track 17. This secures the floating bridge hand rest within the track. At least one riser, as shown in FIG. 1, can then be removably secured to the end opposite the securing member 14 such that the floating bridge hand rest is supported against the instrument at each end. In another embodiment, the riser comprises a lower surface having a coefficient of friction greater than one, to prevent the floating bridge hand rest from rotating. In this way, the user has a stable platform upon which to rest a hand. The floating bridge hand rest can also be secured above a fixed bridge such that a more comfortable anchor point than the fixed bridge is provided to the user.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An instrument hand rest, comprising:

a hand rest platform having a body wherein a pair of opposing ends extend therefrom;

wherein the pair of opposing ends curve perpendicularly away from the body creating an arcuate shape;

wherein the hand rest platform is configured to span a plurality of strings of an instrument;

a securing member integrally affixed to at least one of the pair of opposing ends, the securing member extending perpendicularly therefrom;

wherein the securing member includes at least one aperture therethrough, the aperture configured to receive the fastener therethrough into the instrument such that the hand rest platform is removably secured to the instrument;

a plurality of risers removably securable to the securing members, wherein the plurality of risers are configured to elevate the body to a desired height;

wherein the plurality of risers each comprise a U-shaped cutout configured to receive the fastener therein.

2. The instrument hand rest of claim 1, wherein the body comprises a planar upper surface parallel to a mounting surface of the instrument.

3. The instrument hand rest of claim 2, wherein the planar upper surface comprises a wider cross-section than the pair of opposing ends.

4. An instrument hand rest, comprising:

a hand rest platform having a body wherein a pair of opposing ends extend therefrom;

wherein the pair of opposing ends curve perpendicularly away from the body creating an arcuate shape;

wherein the hand rest platform is configured to span a plurality of strings of an instrument;

a securing member integrally affixed to at least one of the pair of opposing ends, the securing member having an aperture therein configured to receive a fastener therethrough, such that the securing member is removably securable to the track via the fastener;

a track removably affixed to an instrument at a hole disposed within the track;

wherein the securing member is slidably engaged with the track.

5. The instrument hand rest of claim 4, wherein the track further comprises a plurality of openings, wherein the fastener is configured to engage one of the plurality of openings when the aperture is aligned therewith such that the securing member is secured to the track.

6. The instrument hand rest of claim 4, further comprising a platform slidably engaged with the track, wherein the platform is further configured engage a fastener inserted therein, such that the platform selectively moves between a raised position and a lowered position as the fastener is tightened and loosened respectively, and wherein the securing member is frictionally engaged between the platform and a pair of upper arms of the track when the platform is in the raised position.

7. The instrument hand rest of claim 4, wherein the track is rotatably affixed to the instrument about the hole.

8. The instrument hand rest of claim 4, wherein the body is configured to rotate about the aperture.

9. The instrument hand rest of claim 4, wherein a lower side of the securing member comprises a material having a coefficient of friction greater than one.

10. The instrument hand rest of claim 4, wherein the body comprises a planar upper surface parallel to a mounting surface of the instrument.

11. The instrument hand rest of claim 10, wherein the planar upper surface comprises a wider cross-section than the pair of opposing ends.

12. The instrument hand rest of claim 4, wherein a lower surface of the track further comprises a material having a coefficient of friction greater than one.

13. The instrument hand rest of claim 4, further comprising a disc disposed on the end opposite the securing member.

14. The instrument hand rest of claim 6, wherein the fastener is configured to extend through the platform when the fastener is tightened, such that the platform is moved to the raised position thereby.

* * * * *